US005398349A

United States Patent [19]

Haberler

[11] Patent Number: 5,398,349

[45] Date of Patent: Mar. 21, 1995

[54] POOL COVER

[76] Inventor: Gerhard Haberler, 41 Acorn Pl., Winnipeg, Manitoba, Canada, R3R 1Y5

[21] Appl. No.: 138,432

[22] Filed: Oct. 20, 1993

[51] Int. Cl.[6] ..... E04H 4/14

[52] U.S. Cl. ..... 4/498; 4/496

[58] Field of Search ..... 4/496, 498

[56] References Cited

U.S. PATENT DOCUMENTS

| | | | |
|---|---|---|---|
| 3,872,522 | 3/1975 | Bennett et al. | 4/498 |
| 4,236,259 | 12/1980 | Wendt | 4/498 |
| 4,284,060 | 8/1981 | McCluskey | 4/498 X |
| 4,366,806 | 1/1983 | Acker | 4/498 X |
| 4,749,606 | 6/1988 | Moore | 4/498 X |
| 4,875,466 | 10/1989 | Slonneger | 4/498 X |
| 5,067,182 | 11/1991 | Koelsch | 4/498 |

*Primary Examiner*—Charles E. Phillips

*Attorney, Agent, or Firm*—Adrian D. Battison; Stanley G. Ade; Murray E. Thrift

[57] ABSTRACT

A pool cover is formed by a plurality of hexagonal pads which float separately on the pool surface and orient themselves to cover the majority of the pool service in edge to edge floating relationship. The pads can be removed from the pool and stacked together on top of each other up to for example 5 or 6 high with the top cover panel being shaped to define a seat or a table top surface. The seat is supplemented by a seat back structure which is snap fastened into place on top of the seating surface. Each side edge of the hexagonal panel has a hand hold arrangement with downwardly projecting underside ribs to assist stacking. A central lock bar or key extends through vertically aligned holes in the panels to lock them in the stack. The cover panels thus can be connected together to form pool furniture around the pool to provide a useful function rather than merely requiring storage space.

15 Claims, 5 Drawing Sheets

POOL COVER

BACKGROUND OF THE INVENTION

This invention relates to a pool cover for covering a swimming pool.

It is highly desirable to cover swimming pools when their not in use so as to reduce evaporation and heat loss which can significantly increase the cost of maintaining the pool. Many covers are in the form of a simple sheet of plastics material with the sheet being placed over the water surface either in contact with the water surface or above the water surface at the top surface of the pool. Many covers are formed with bubbles so that the cover is buoyant on the surface of the water and can thus lie on the surface of the water. Covers of this type also have the advantage that they can absorb heat from sunlight and communicate this into the water so as to reduce heat loss and at the same to increase heat gain.

Sheet type covers of this type are highly suitable for relatively small pools such as residential pools but become extremely difficult to manage and maneuver when used on larger pools of the commercial type or pools of a complex shape. Many such pools remain uncovered for these reasons. It has previously been proposed to cover a pool with a plurality of hexagonal elements which are separate and buoyant so as to simply float on the pool surface, sometimes known as lily-pads. The elements are suitably shaped so that they line up edge to edge and thus cover the majority of the pool surface. The hexagonal shape is preferred but it will be appreciated that other shapes are possible. The elements or pads thus float on the surface and tend to organize themselves into the required pattern to cover the majority of the surface. In one example, a device of this type was manufactured from foamed plastics materials which tends to be relatively brittle and hence prone to damage. In another example shown in U.S. Pat. No. 4,270,232 (Ballew) a hexagonal rigid frame is covered with a material which allows penetration of sunlight through the upper surface and provides insulation due to an air space between the upper surface and a lower surface.

However the major disadvantage with rigid elements of this type is that they are extremely cumbersome and bulky when removed from the pool. A fabric cover can be rolled, the rigid elements can of course be stacked but even when stacked take up relatively large area. For this reason the use of rigid panels, or "lily pads" has been essentially disregarded in the industry.

SUMMARY OF THE INVENTION

It is one object of the present invention, therefore to provide an improved swimming pool cover of the type which uses rigid panels.

According to the first aspect of the invention there is provided a pool cover comprising a plurality of separate elements each of which is buoyant in water and has a bottom surface for sitting on the water, a top surface and side edges, the element being shaped in plan view such that together, when lying on a pool surface, the elements combine in edge to edge arrangement to cover a major portion of the pool surface, and means for converting at least one of the elements when removed from the pool into a seat.

According to the second aspect of the invention there is provided a pool cover comprising a plurality of separate elements each of which is buoyant in water and has a bottom surface for sitting on the water, a top surface and side edges, the element being shaped in plan view such that together, when lying on a pool surface, the elements combine in edge to edge arrangement to cover a major portion of the pool surface, and means for connecting together a plurality of the elements into a stack of the elements arranged one on top of another.

The individual panels or elements of the cover therefore can be connected together into a stack with an uppermost one of the panels defining a seating surface. Preferably a seat back assembly is provided as a separate element which can be snapped into place using a rear strap arrangement which engages around a rear edge of the hexagonal panel and two side fastener elements at the ends of the arms of the seat back portion which engage around side edges on either side of the front edge of the hexagonal panel.

Preferably the panels are connected together in a stack of the order of five or six high using a central link bar which extends through a central opening aligned through the panels with a link bar being rotatable to hold the panels coupled together.

Preferably a plurality of the elements are formed as table top elements with a smooth upper surface and with again the coupling arrangement which allows them to be stacked. The table top elements thus can be positioned adjacent the seating elements to provide in effect seating furniture which becomes a useful structure around the periphery of the pool rather than the conventional arrangement where the elements simply take up valuable storage area.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 7:
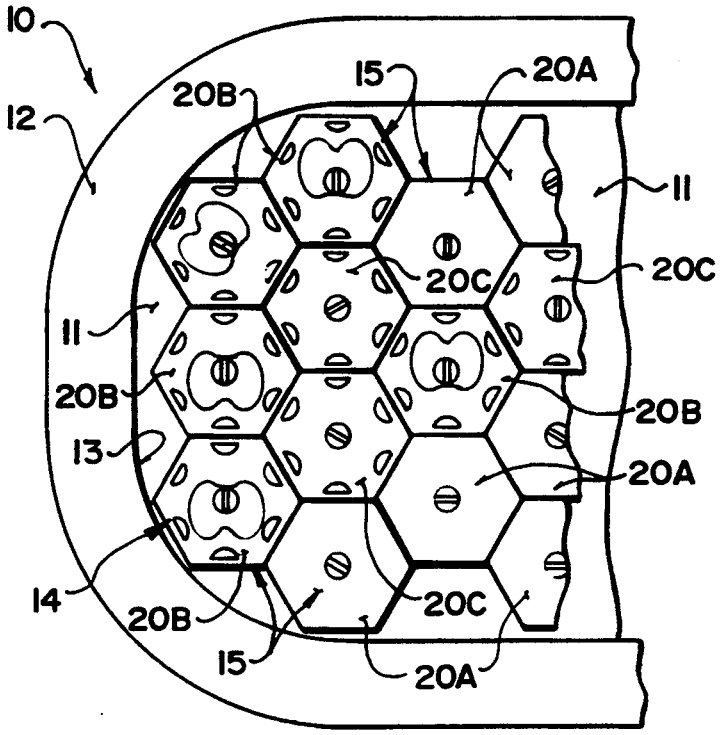
FIG. 7 is a top plan view of a portion of a pool with the cover elements of the present invention arranged edge-to-edge on the surface of the pool water to define a pool cover.
Figure 2:
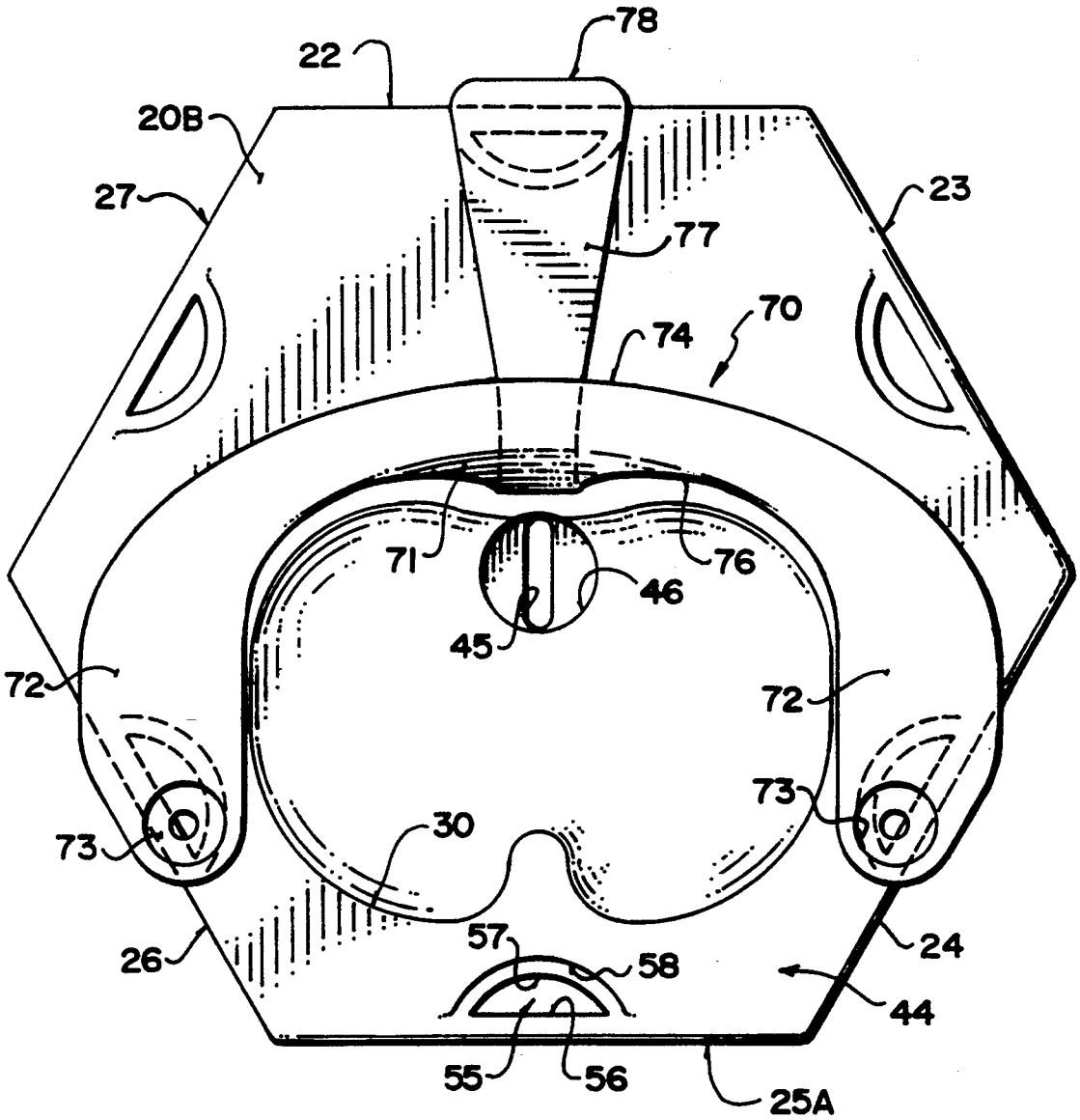
FIG. 2 is a top plan view of the chair of FIG. 1.
Figure 3:
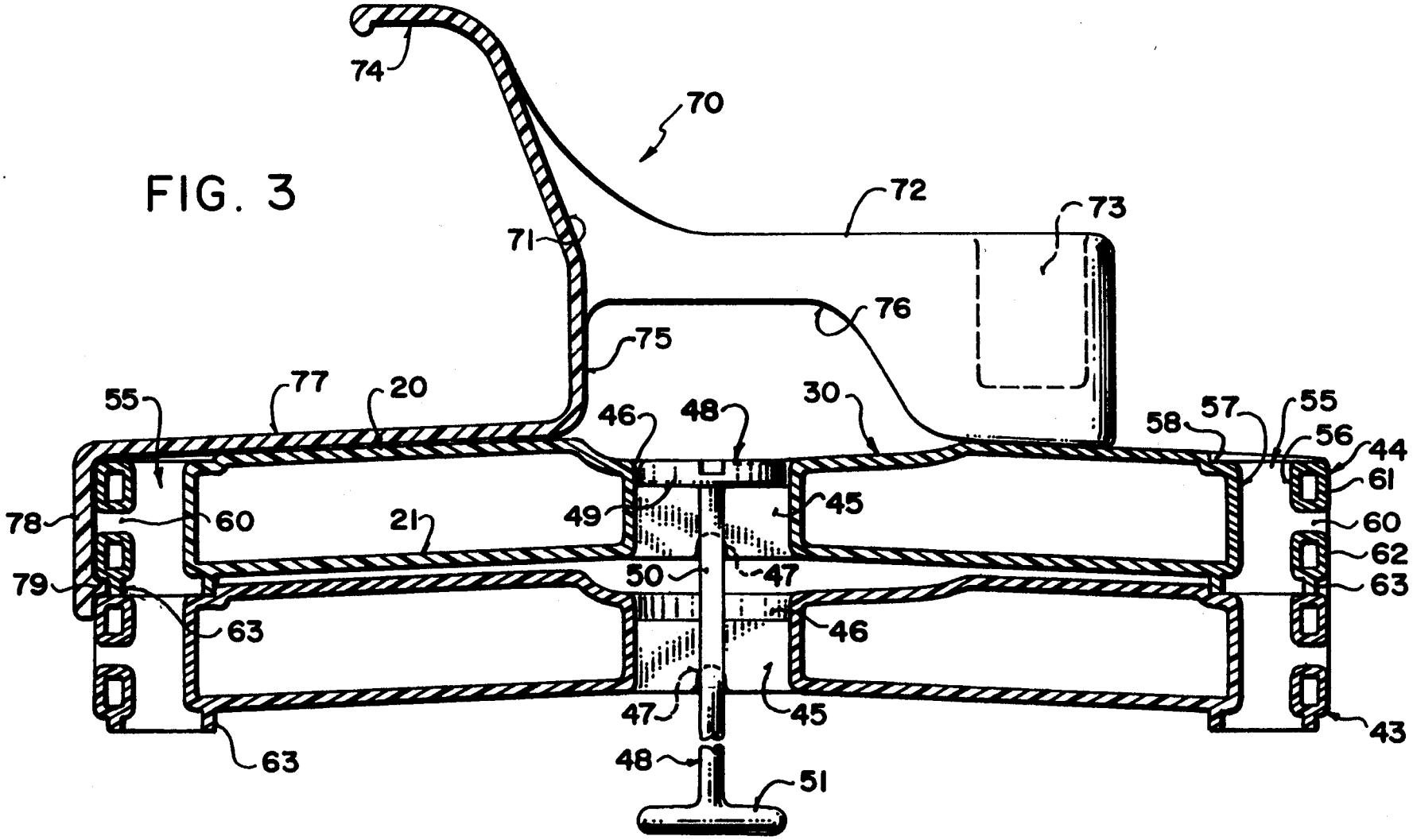
FIG. 3 is a vertical cross sectional view through the chair of FIG. 1.

In FIG. 7 is shown a pool 10 having a water surface 11 and a surrounding walkway 12. The water surface is surrounded by a pool wall 13 of a curved or complex shape. A cover 14 is laid on the pool surface and includes a plurality of cover elements 15 of hexagonal plan view. As shown the cover elements orient themselves so as to lie edge to edge covering the majority of the pool surface leaving spaces around the periphery at which the pool water is exposed. However the proportion of covered water to exposed water is generally of the order of 90 to 95% so that the uncovered area is relatively small in comparison with the effective covered area.

One major advantage of a cover of this type is that the individual elements can move apart in the event that a person should enter under the cover either by falling or by misadventure. There is very much reduced danger therefore of such a person becoming trapped under the cover which in a large pool area can be very dangerous. In addition the individual cover panel elements act as floats so that a person falling into the pool can use them to hold themselves above the water surface simply by pushing apart the cover elements and grasping those immediately adjacent.

The cover elements are all identically shaped and each includes a top wall 20, a bottom wall 21 and side edges 22, 23, 24, 25, 26 and 27. Each of the cover elements is molded from plastics material to define a hollow interior between the walls thus rendering it buoyant and enabling the manufacture from a relatively small quantity of plastics material. The hollow interior can be filled with foam in some cases if preferred since this may increase the insulation effect and also may prevent entry of water into the hollow interior in the event that the outer periphery becomes punctured.

Figure 6:
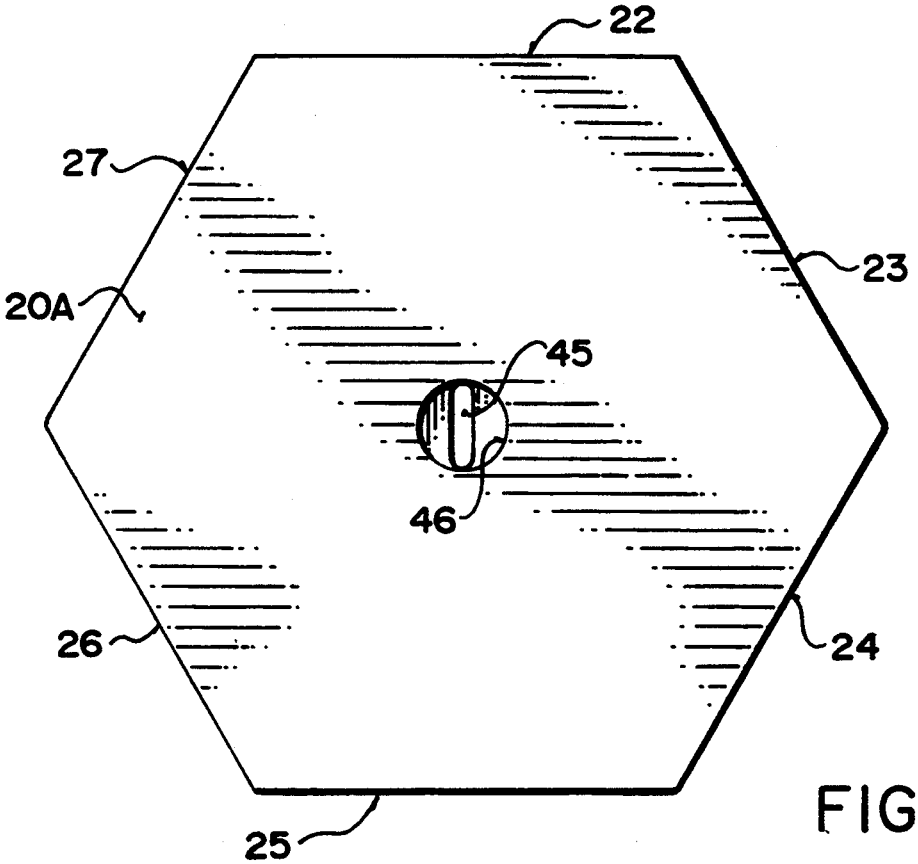
FIG. 6 is a top plan view of a cover element arranged for forming a table top.

The cover elements are preferably manufactured in three different types. As shown in FIG. 6, a first type comprises a table top element in which the upper surface 20A is formed as a flat planar surface free from indentations or projections so that it is smooth to act as a table top.

Figure 5:
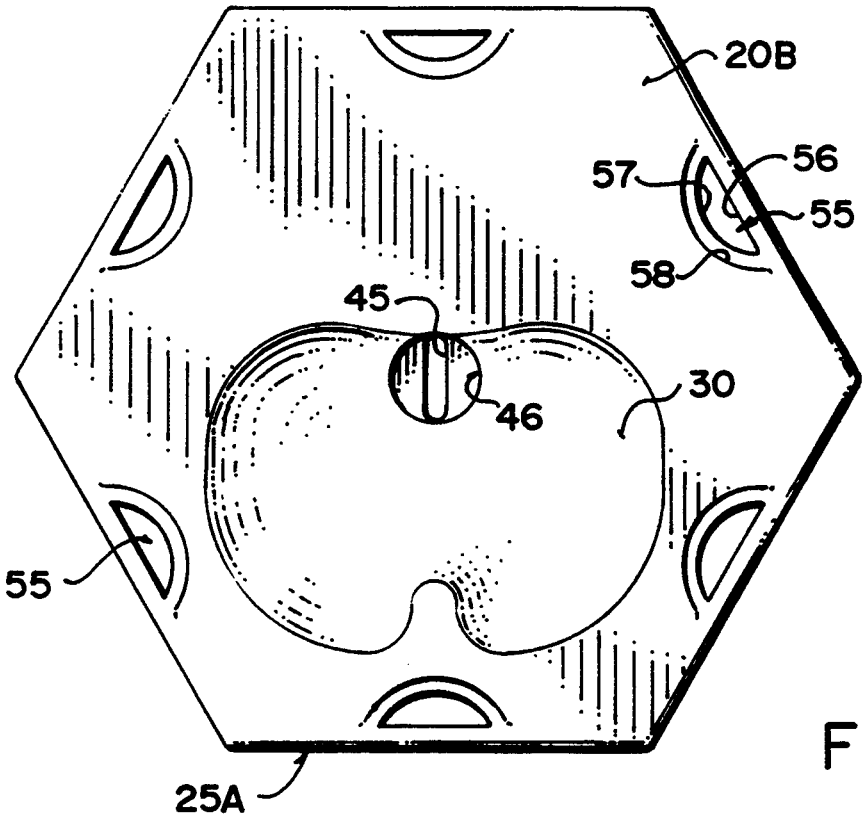
FIG. 5 is a top plan view of the cover element for use in forming the chair of FIG. 1.

A second type of the element is indicated in FIG. 5 which comprises a seating element with the top surface 20B which is mainly planar. However the top surface includes a seating area 30 shaped to receive the buttocks of the average person when sitting so as to form the appearance of a seat facing a front edge 25A of the element.

In addition the elements include a third type in which the top surface is indicated at 20C which is similar in shape to the top surface 20B but omits the seating area 30. Thus it will be noted that the table top 20A includes no hand holds of the type described hereinafter whereas the element 20C includes such hand holds. The top surface 20B includes both the hand holds and the seating area 30.

The elements including the top surface 20C are intended merely as stacker elements which can be used with either the seating elements having the top surface 20B or the table top elements having the top surface 20A. Alternatively the stacker elements may be of the shape having a top surface 20B. The relative numbers of the various types of elements in a full cover are selected so that the cover can be broken down into the separate elements and the elements are then assembled to form stacks of the elements including a plurality of stacker elements with an upper most one of the elements forming a seating element or a plurality of the stacker elements together with an uppermost one of the elements forming a table top element.

Figure 1:
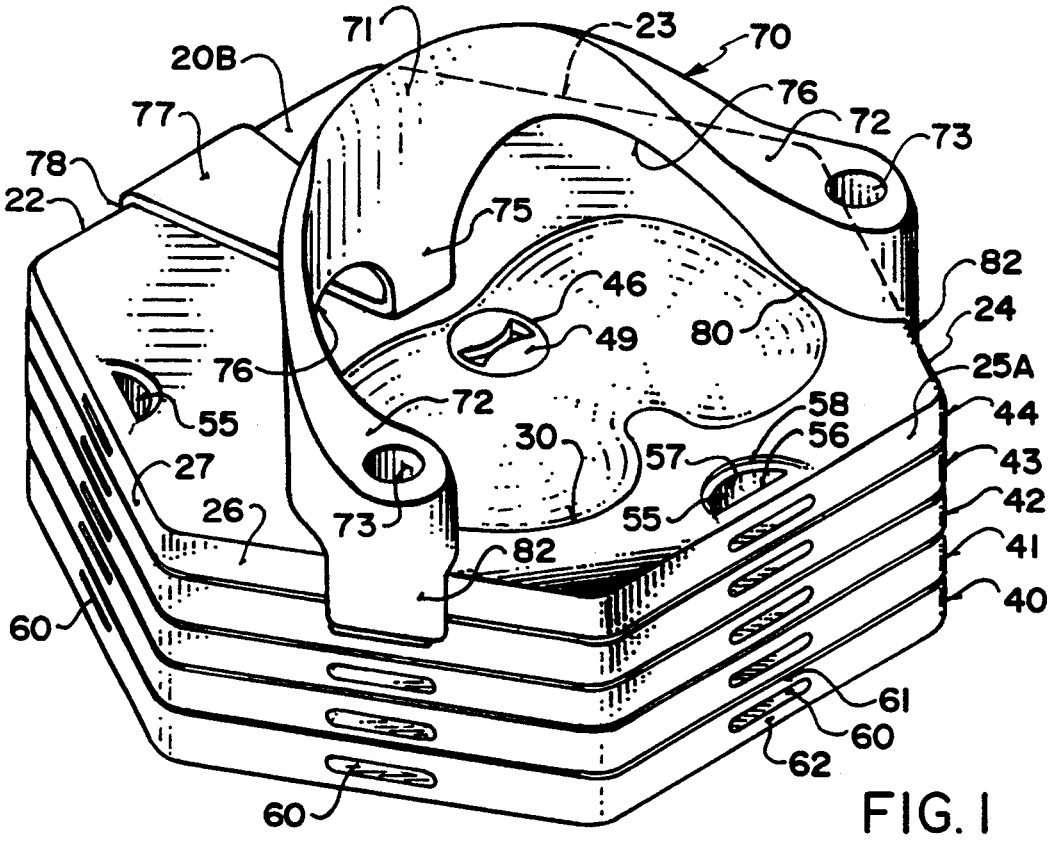
FIG. 1 is an isometric view of one chair formed from a stack of pool cover elements according to the invention.
Figure 4:
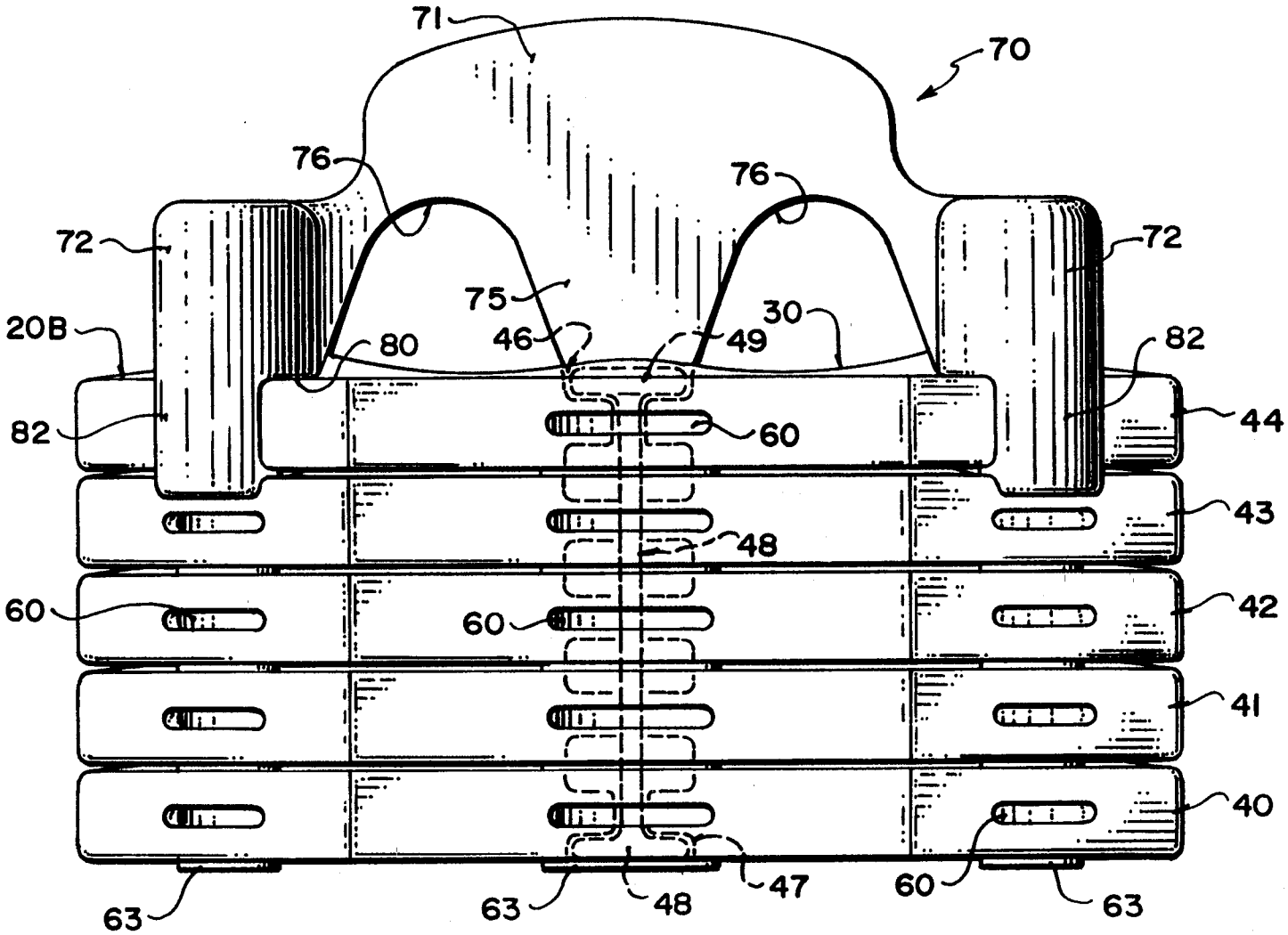
FIG. 4 is a front elevational view of the chair of FIG. 1.

As shown in FIGS. 1 and 4, the number of stacker elements is preferably 4 with the uppermost element providing a 5th element defining a chair. Similarly the table top elements will in general form the top element of a further stack of 4 other stacker elements to define a table of a height equal to the height of the chair.

Turning now to FIGS. 1, 2, 3 and 4. The chair is formed from 5 of the elements indicated respectively at 40, 41, 42, 43 and 44. Each of the elements has a central slot shaped opening 45 extending through a centre point of the element from the top surface 20 through the bottom surface 21, the slot shaped opening being molded into the material so as to close the hollow interior. Around the slot shaped opening is defined a recess 46 which depends downwardly from the top surface 20. Similarly each bottom surface 21 has a recess 47 which again is circular similar to the recess 46. This allows the elements to be connected together by a link bar 48 which has a cap 49 which sits in the recess 46, a vertical rod 50 extending through the recesses and transverse lock bar 51 at the lower end. In connection of the elements in stacked arrangement, the link bar is inserted into the slots 45 with the transverse lock bar 51 parallel to the slot and with the slots 45 aligned so that the top cap 49 extends downwardly and is received within the top recess 46 of the top element. The length of the link bar is arranged so that the transverse bar 51 is received within the bottom recess 47. Rotation of the link bar through 90° then turns the lock bar 51 to a position transverse to the slot 45 preventing it from being removed from the elements. The link bar thus holds the elements connected together. The surfaces of the recess 46 and 47 may be suitably shaped to locate the link bar in the required orientation to hold it in a locked position.

At a position midway along each side of the elements is provided a hand hold member 55. The hand hold member 55 is molded as an opening through the body from the upper surface 20 to the lower surface 21 which opening has a straight edge 56 adjacent the side of the element and a curved edge 57 on the opposed side away from the edge of the element. In addition the hand hold portion includes a recess 58 around the edge 57. The hand hold 55 is also molded so as to define a slot shaped opening 60 breaking out on the edge wall of the element. This forms two portions 61 and 62 of the body which are tubular at the hand hold which can be grasped by the hand of the user inserting the fingers for example into the top of the hand hold and outwardly through the slot 60.

At the bottom of the hand hold is provided a peripheral rib 63 which surrounds the underside of the hand hold and projects downwardly into engagement with the recess 57 of the top surface of the element beneath that element. Thus the projections 63 act to locate each element on top of the next adjacent element and prevent sliding side to side of the elements.

The chair structure defined by the top element is completed by a back rest portion generally indicated at 70. The back rest portion is molded from plastics material and defines a seat back 71 and a pair of arms 72 treated to the back rest portion and extending therefrom forwardly and to the sides to surround the seating indent 30. Each arm includes a cup receiving cylindrical opening 73 of the type widely used in pool furniture.

The back 71 curves upwardly and rearwardly and includes a top flange 74 extending rearwardly over the element behind the seating indent 30. At the bottom of the back, the back includes a vertical leg 75 and two arched openings 76 on either side of the leg 75. At the bottom of the leg 75 is provided a rearwardly extending attachment strap 77 which lies across the top surface of the element and includes a downturned flange 78 at the edge of the element which turns down around the rear edge 22 of the element beyond the opening 55. The flange 78 includes a notch 79 engaging as a snap fit into the recess defined between the bottom of the top element and the top of the next adjacent element.

The arms 72 have a top surface increasing in width forwardly toward the front edge adjacent the sides 24 and 26 of the element. The underside of each arm extends downwardly from the arch 76 to a bottom edge 80 lying along the top surface of the element just outside the seating recess 30. The arm thus sits flat on top of the upper surface of the element adjacent the side edges 24 and 26.

At the side edges each arm includes a downwardly extending fastening flange 82 which engages around the respective side edge 24, 26 and includes a notch on the inwardly facing surface thereof (not visible) which engages again between the under edge of the top element and the top edge of the next adjacent element. The seat back is therefore snap fastened in place by engaging the flanges 82 at the sides on either side of the front edge and then by pulling the strap 77 rearwardly until the flange 78 engages over the rear edge 22. The elasticity of the seat back formed from plastics material allows it to remain in place during regular use but it can be readily removed when it is intended that the seat element be returned to its first function as a pool covering element.

The structure thus defined enables the pool cover elements to be stacked to a predetermined height and to be coupled together in the stacks so that they can be moved readily as a coupled unit. The stacks can then be used either as a table top or as a seating element depending upon the shape of the top surface and the seating elements can have added the seating back which is readily snap fastened in place. In this way the pool cover when removed becomes a useful functional furniture structure surrounding the pool and providing attractive accommodation as opposed to simply an unsightly storage of utilitarian panels.

Other the designs of seating structure can be used in some cases where there is a premium on space around the pool, thus it will be noted that the seating elements using the seat back allow only a single person to sit on each stack. An alternative arrangement may be provided in which the seating elements form effectively benches where a number of people can be seated for example in commercial pools where a large number of children are to be expected.

In some cases it is desirable to use the seating elements as pool furniture that is as floating lounge chairs or the like. In this case a number of the elements coupled together can be used in the stack previously described as a floating element within the pool. Alternatively the number of elements in the stack can be reduced by the use of a shorter lock bar. In a yet further alternative, a single one of the elements can be used with the seat back but in this case it is necessary to add additional floats attached on the underside of the seating element at the hand holds to provide additional buoyancy and stability.

The cover elements can also be used in other arrangements as pads for use in the pool for example in games and the like. Thus the pads can be connected together to form a walkway spanning the pool where the contestants in the game are required to pass over the walkway without falling into the pool. The provision of the hand holds allows the elements to be connected together to remain in place in a required pattern of the walkway.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A pool cover comprising a plurality of separate elements each of which is buoyant in water and is molded from a plastics material to define a bottom wall for sitting on the water, a top wall spaced upwardly of the bottom wall so as to define a space therebetween and side edges, the element being shaped in plan view such that together, when lying on a pool surface, the elements combine in edge to edge arrangement to cover a major portion of the pool surface, means for connecting together a plurality of the elements into a stack of the elements arranged one on top of another so as to support an uppermost one of the elements spaced from the ground and means for converting at least the uppermost one of the elements when removed from the pool into a furniture element, wherein the connecting means comprises a link member separate from the elements and wherein each of the elements includes an opening therein extending vertically therethrough such that the link member extends through the openings of the elements of the stack when aligned, the link member having means thereon to hold the uppermost one of the elements downwardly onto the stack of elements.

2. The pool cover according to claim 1 wherein the opening of each element is arranged adjacent a mid point of the element.

3. The pool cover according to claim 1 wherein the link member comprises a bar which includes a transverse locking member arranged such that rotation of the link bar about an axis longitudinal of the link bar causes the transverse locking element to be moved into a locking position.

4. The pool cover according to claim 1 wherein at least the uppermost one of the elements includes a seat shape formed in the top wall for receiving a seated person and a seat back portion against which the back of the seated person may rest.

5. The pool cover according to claim 4 wherein the seat back portion is readily removable and replaceable on the element.

6. The pool cover according to claim 5 wherein the seat back portion includes arms extending forwardly from the seat back, the arms including fastener portions extending downwardly therefrom for engaging around an edge of the element.

7. The pool cover according to claim 6 wherein the element is substantially hexagonal so as to define a front side edge between the arms, two side edges adjacent the front side edge over which the arm fasteners engage and a rear side edge parallel to the front edge over which the rear strap engages.

8. The pool cover according to claim 4 wherein the seat back portion includes arms.

9. The pool cover according to claim 4 wherein seat back portion includes a rear strap member arranged to extend across the top wall and to engage around a side edge of the element.

10. The pool cover according to claim 1 wherein some of the elements have a planar top wall and include means for converting said elements with a planar top wall into a table top.

11. A pool cover comprising a plurality of separate elements each of which is buoyant in water and is molded from a plastics material to define a bottom wall for sitting on the water, a top wall spaced upwardly of the bottom wall so as to define a space therebetween and side edges, the element being shaped in plan view such that together, when lying on a pool surface, the elements combine in edge to edge arrangement to cover a major portion of the pool surface, means for connecting together a plurality of the elements into a stack of the elements arranged one on top of another so as to support an uppermost one of the elements spaced from the ground wherein at least the uppermost one of the elements includes a seat shape formed in the top wall for receiving a seated person and a seat back portion against which the back of the seated person may rest.

12. The pool cover according to claim 11 wherein the seat back portion is readily removable and replaceable on the element.

13. The pool cover according to claim 12 wherein seat back portion includes a rear strap member arranged to extend across the top wall and to engage around a side edge of the element.

14. The pool cover according to claim 13 wherein the seat back portion includes arms extending forwardly from the seat back, the arms including fastener portions extending downwardly therefrom for engaging around an edge of the element.

15. The pool cover according to claim 14 wherein the element is substantially hexagonal so as to define a front side edge between the arms, two side edges adjacent the front side edge over which the arm fasteners engage and a rear side edge parallel to the front edge over which the rear strap engages.

* * * * *